US007086430B2

(12) United States Patent
Walton

(10) Patent No.: US 7,086,430 B2
(45) Date of Patent: Aug. 8, 2006

(54) FEED TUBE FOR USE IN A LIQUID DELIVERY SYSTEM

(75) Inventor: Philip Andrew Walton, Bishop Auckland (GB)

(73) Assignee: Ebac Limited (GB)

( * ) Notice: Subject to any disclaimer, the term of this patent is extended or adjusted under 35 U.S.C. 154(b) by 100 days.

(21) Appl. No.: 10/499,795

(22) PCT Filed: Dec. 18, 2002

(86) PCT No.: PCT/GB02/05756

§ 371 (c)(1),
(2), (4) Date: Jun. 22, 2004

(87) PCT Pub. No.: WO03/055787

PCT Pub. Date: Jul. 10, 2003

(65) Prior Publication Data

US 2006/0054243 A1 Mar. 16, 2006

(30) Foreign Application Priority Data

Dec. 21, 2001 (GB) ..... 0130597.8

(51) Int. Cl.
*B65B 1/04* (2006.01)

(52) U.S. Cl. ..... 141/330; 141/319; 141/329; 141/352; 141/363; 141/364; 141/365; 141/366

(58) Field of Classification Search ..... 141/312, 141/319, 329, 330, 351, 352, 363–366, 284, 141/375; 222/80–82
See application file for complete search history.

(56) References Cited

U.S. PATENT DOCUMENTS 2,007,449 A * 7/1935 Kernodle et al. ..... 222/90
4,699,188 A * 10/1987 Baker et al. ..... 141/18
5,071,035 A * 12/1991 Kiplinger ..... 222/83.5

* cited by examiner

*Primary Examiner*—Timothy L. Maust
(74) *Attorney, Agent, or Firm*—Ira S. Dorman

(57) ABSTRACT

An inverted container has a generally cylindrical depending neck, with a cap 18 having an outer wall 19 which engages the neck and an internal sleeve 20 located within the neck and joined to the outer wall by a connecting wall 21. The internal sleeve 20 defines a recess for receiving the feed tube 34, and a frangible seal 28 is secured to the connecting wall of the cap to cover the recess prior to insertion of the feed tube. To prevent pieces of the seal 28 from being separated if the feed tube 34 is inserted with the seal 28 still in place the feed tube has at least one row of upwardly-projecting puncturing elements 48 which create a controlled rupture of the seal prior to penetration of the feed tube.

11 Claims, 4 Drawing Sheets

FEED TUBE FOR USE IN A LIQUID DELIVERY SYSTEM

TECHNICAL FIELD OF THE INVENTION

This invention relates to a feed tube for use in a delivery system for delivering potable liquid from an inverted container to a reservoir.

BACKGROUND

EP 0 581 491 A describes a liquid dispenser which includes a hygienic delivery system for delivering water or other potable liquid from an inverted container to a reservoir in which the liquid is heated or cooled before passing to a discharge outlet. The dispenser is used with inverted containers having a depending neck which is closed by a cap having an internal sleeve sealed by an inner plug. When the container is placed onto the equipment a feed tube sealably enters the sleeve to provide a flow path from the container to the reservoir. A high level of hygiene can be maintained by forming the feed tube as part of a removable unit which can be periodically discarded and replaced together with the reservoir and the interconnecting tubing.

In such systems the containers are supplied with a seal covering the sleeve into which the feed tube is to be inserted. This prevents dirt from collecting in the recess formed by the sleeve prior to use, which would otherwise be introduced into the container and contaminate the contents. The seal is formed by a thin sheet of material which is adhesively secured to the cap and provided with a tab by which the seal can be pulled off the cap immediately prior to use. However, the seal is formed of a frangible material and users often leave the seal in place since it is easily ruptured by the feed tube. This may lead to pieces of the seal becoming detached, which can lodge between the feed tube and the sleeve resulting in an inadequate seal and consequent leakage problems. Pieces of the seal may also enter the container which not only looks unsightly but may also contaminate the contents causing taste and hygiene problems. Furthermore, the pieces of seal can block the water passages or adhere to the inside of the empty container, making them difficult to clean effectively prior to re-filling.

The present invention seeks to provide a new and inventive form of feed tube which overcomes these problems.

SUMMARY OF THE INVENTION

The present invention proposes a feed tube for use in a delivery system for transferring potable liquid from an inverted container to a reservoir, the inverted container having a generally cylindrical depending neck, with a cap having an outer wall surrounding at least a portion of said neck and an internal sleeve located within the neck and joined to the outer wall by a connecting wall, the internal sleeve defining a recess for receiving the feed tube, and a frangible seal being secured to the connecting wall of the cap to cover the recess prior to insertion of the feed tube, said feed tube containing a flow path for delivering liquid from the inverted container to a reservoir, characterised in that said feed tube has at least one row of upwardly-projecting puncturing elements.

The puncturing elements cause the seal to rupture prior to insertion of the main body of the feed tube so that the feed tube causes the seal to rupture in a controlled way which eliminates random detachment of fragments of the seal.

The feed tube preferably has a plurality of intersecting rows of puncturing elements. Thus, for example, the feed tube may cause the seal to rupture along a single line or in a cruciform configuration.

The or each puncturing element will usually be formed on an uppermost end face of said feed tube, which may be substantially dome-shaped.

The feed tube preferably projects upwardly within a cup-shaped member for receiving the cap.

The feed tube may thus be incorporated in a delivery system for transferring potable liquid from an inverted container to a reservoir, the inverted container having a generally cylindrical depending neck, with a cap having an outer wall surrounding at least a portion of said neck and an internal sleeve located within the neck and joined to the outer wall by a connecting wall, the internal sleeve defining a recess for receiving the feed tube, and a frangible seal being secured to the connecting wall of the cap to cover the recess prior to insertion of the feed tube.

The delivery system is preferably of the kind in which the internal sleeve of the cap includes an integral sealing plug which is frangibly connected thereto such that insertion of the feed tube into the sleeve causes the sealing plug to be separated from the sleeve. The sealing plug is preferably formed with internal gripping means and the feed tube is formed with complimentary external gripping means for securing the plug on the feed tube when the feed tube is inserted into the sleeve.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
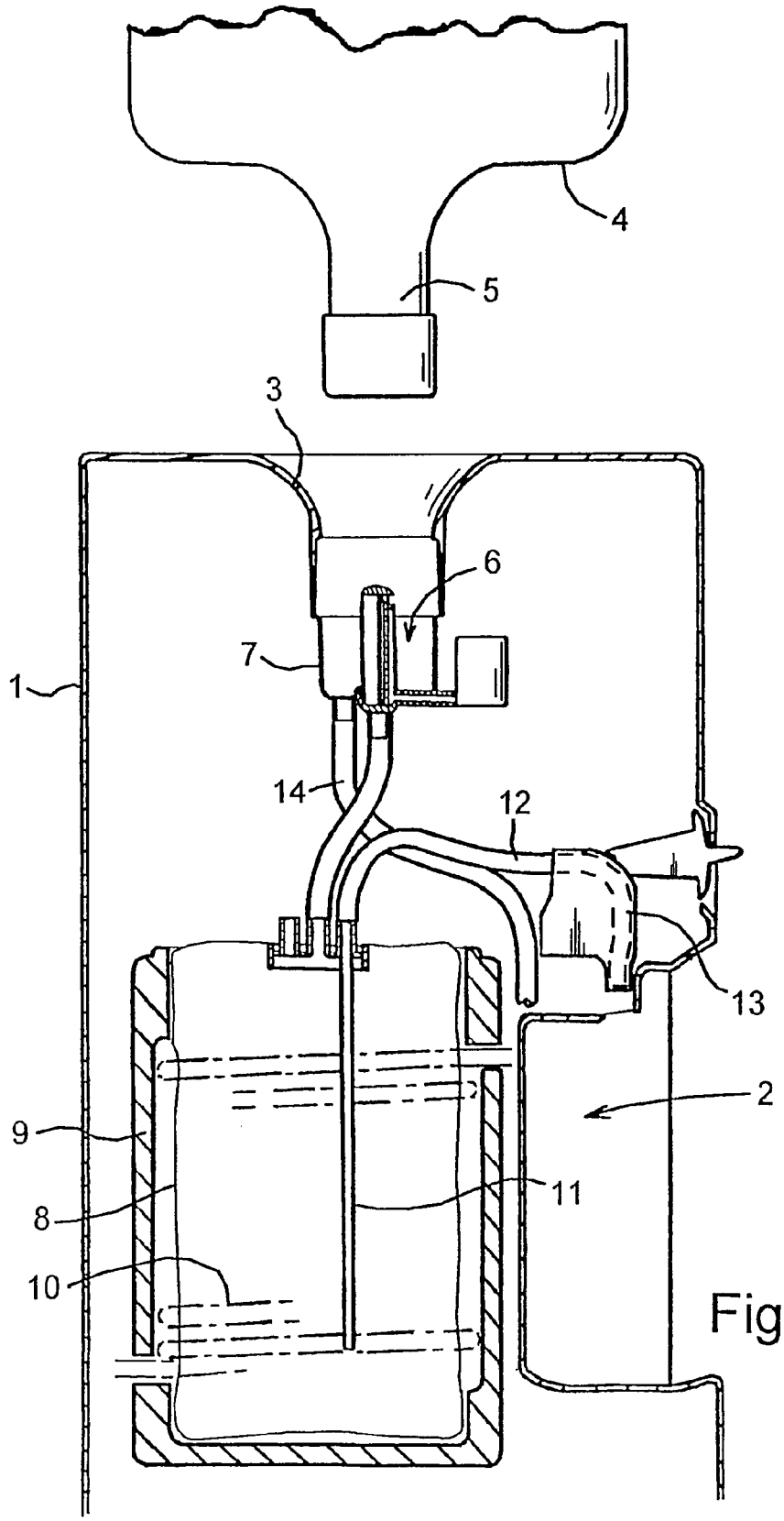
FIG. 1 is a vertical section through a bottled water dispenser incorporating a feed tube and delivery system in accordance with the invention.

FIG. 1 shows a bottled water dispenser having a housing 1 with a dispensing recess 2 formed in its front wall. The top wall of the housing is formed with an annular seat 3 for supporting an inverted bottle 4 having a depending neck 5 which is received within a collar portion 6. A feed tube unit 7 is removably mounted below the collar portion 6 to conduct liquid from the bottle 4 to a reservoir 8 within the housing. The reservoir is formed by a flexible bag which is received within a rigid heat-insulating case 9 lined by cooling coils 10. A dip tube 11 conducts cooled liquid from the reservoir via an outlet tube 12 to a discharge valve 13 at the top of the recess 2. A drain tube 14 conducts any leakage of liquid from the feed tube unit 7 to the recess 2.

Figure 2:
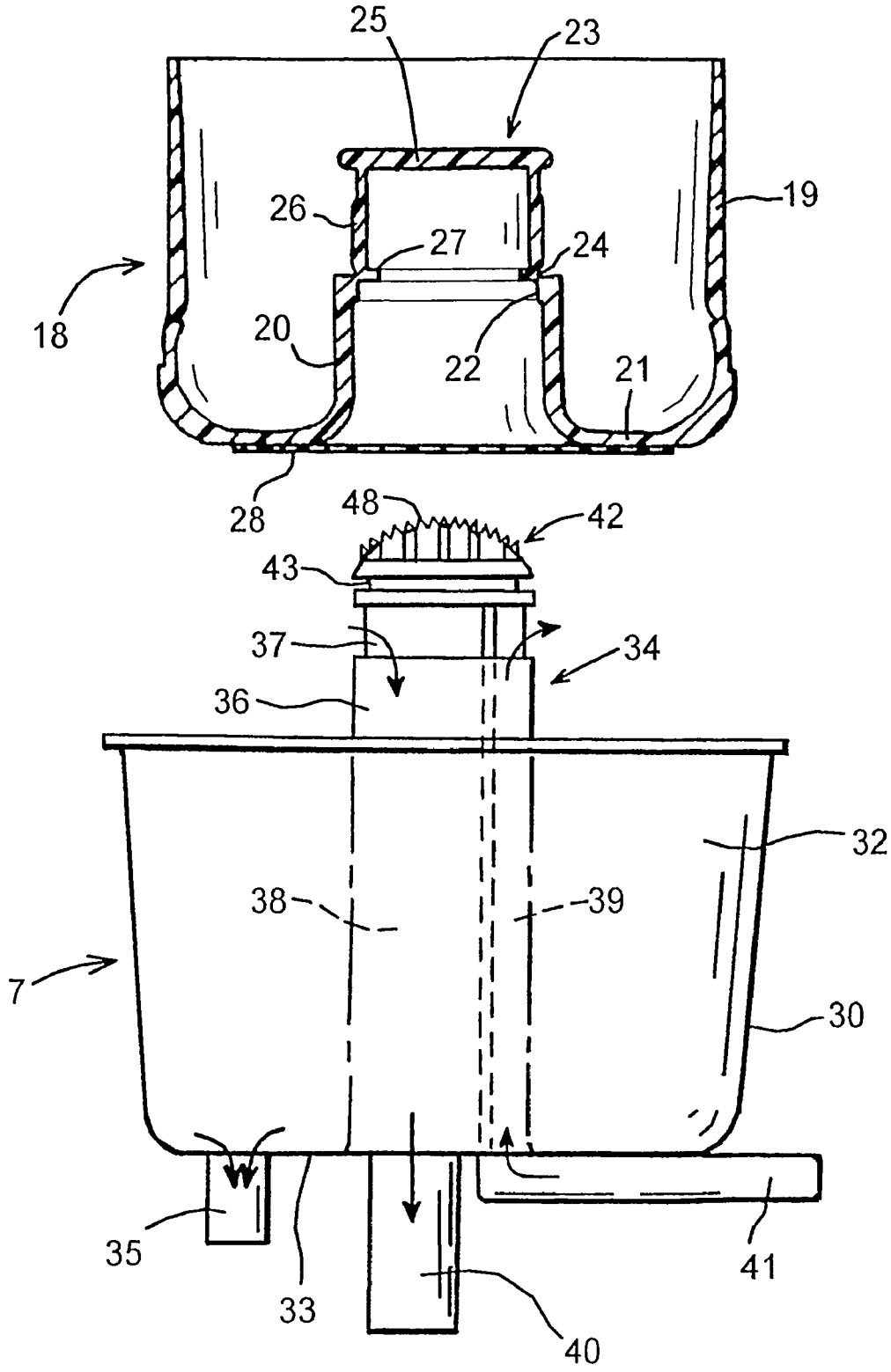
FIG. 2 is a detailed vertical section through part of the delivery system incorporating the feed tube.

FIG. 2 shows the feed tube unit 7 in more detail together with a cap 18 which is a snap-fit on the neck of the bottle 4. The cap includes a generally cylindrical outer wall 19 which is joined to an internal sleeve 20 by an annular wall 21. The inner end of the sleeve 20 has an internal sealing bead 22 and includes an integral sealing plug 23 which is joined to the sleeve 20 by a frangible connection 24. The plug 23 includes a circular end wall 25 and a cylindrical side wall 26 which is provided with an internal gripping rib 27. Prior to use, the recess formed within the sleeve 20 and plug 23 is closed by a thin frangible peelable sealing sheet 28, e.g. of paper or plastics, which is adhesively secured to the annular wall 21.

Figure 3:
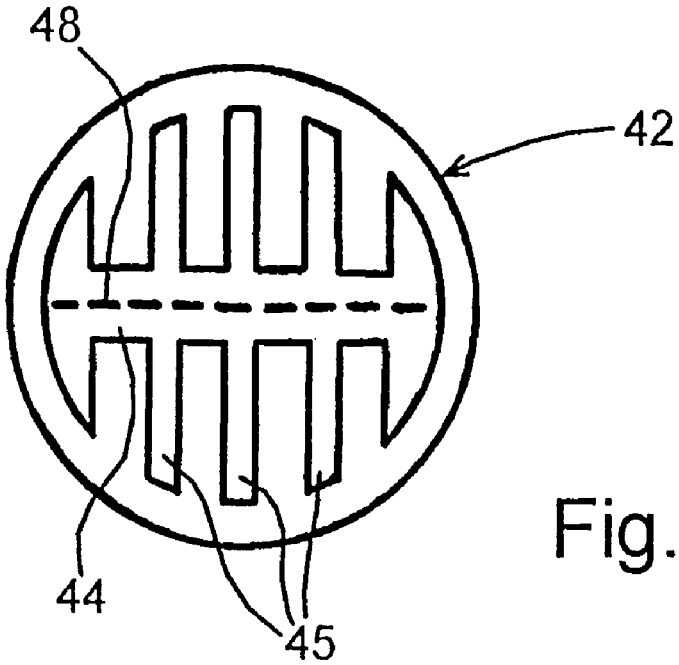
FIG. 3 is a plan view of the top of the feed tube shown in FIG. 2.

The feed tube unit 7 includes a collecting cup 30 having a side wall 32 and a bottom wall 33 from which the feed tube 34 projects upwardly. An outlet spigot 35 allows any leakages to drain from the cup 30 via the drain tube 14. The feed tube 34 has a cylindrical wall 36 containing a cruciform wall 37 which divides the interior space within the tube into at least one delivery passage 38 and one or more air passages 39. The or each delivery passage communicates with a connecting spigot 40 on the bottom of the cup to supply water to the reservoir 8 whereas the air passage or passages communicate with an inlet pipe 41 which supplies air from an air filter (not shown) to replace water removed from the bottle. The cruciform wall 37 projects above the top of the cylindrical wall 36 to support a domed head 42 which is formed with a gripping groove 43. Although the head could be solid (see below), it will be seen in FIG. 3 that, for moulding purposes, the domed top surface of the head may be provided by a single diametrical wall 44 and a plurality of transversely intersecting parallel walls 45. In accordance with the invention the diametrical wall 44 has a row of upwardly projecting teeth 48. The teeth are integrally formed with the head 42 although they could be provided by a metal inert.

Figure 4:
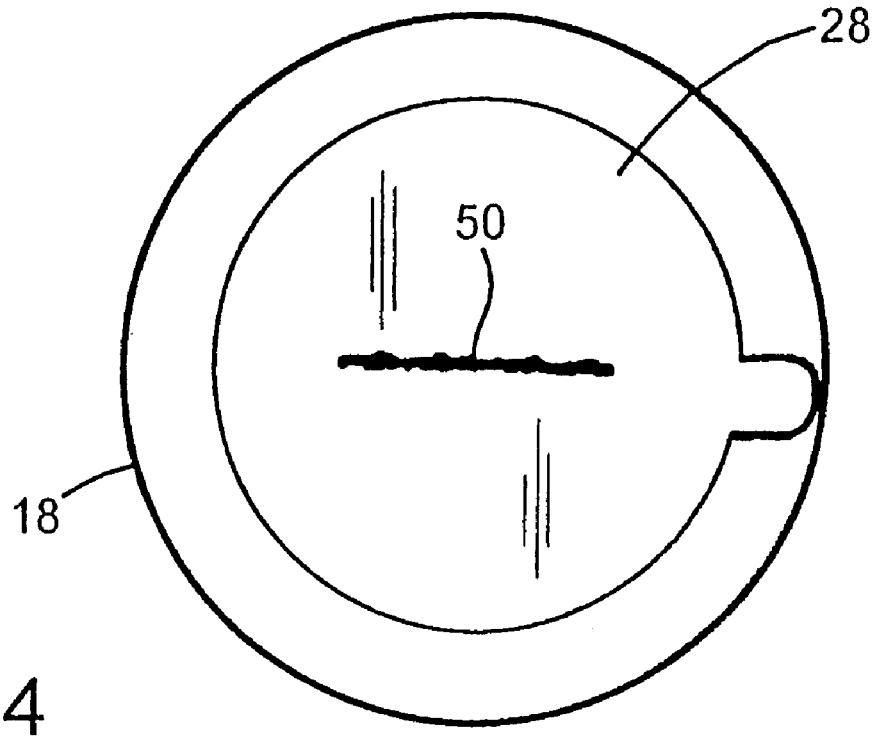
FIG. 4 is a plan view of the cap showing the seal after penetration by the feed tube.

When a new bottle is lowered onto the dispenser, if the seal 28 has not been removed the teeth 48 puncture the sheet forming a controlled slit-like rupture 50, as shown in FIG. 4, through which the feed tube 34 may pass. As the feed tube enters the sleeve 20 the margins of the slit 50 are deflected inwardly between the sleeve 20 and the wall 36 of the feed tube but since they remain attached to the sheet 28 they are unable to enter the bottle. When the head 42 of the feed tube enters the plug 23 the rib 27 enters the groove 43 so that the plug becomes separated from the sleeve 20 but remains engaged with the head 42. The bead 22 forms a seal with the wall 36 of the feed tube to prevent leakages.

Figure 5:
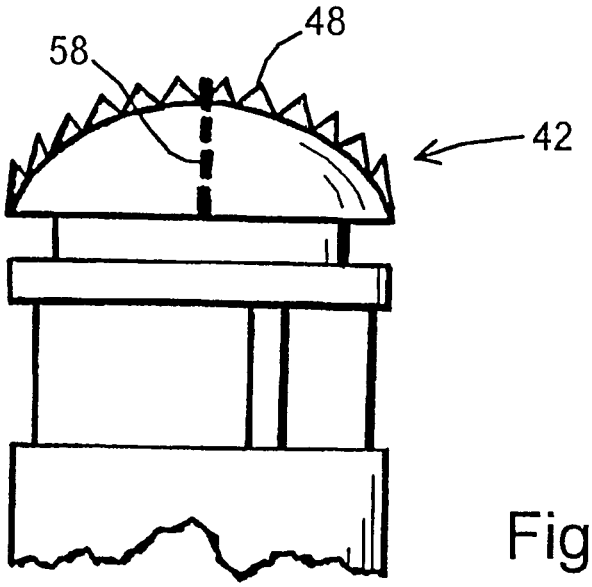
FIG. 5 is a side view of an alternative form of feed tube in accordance with the invention.
Figure 6:
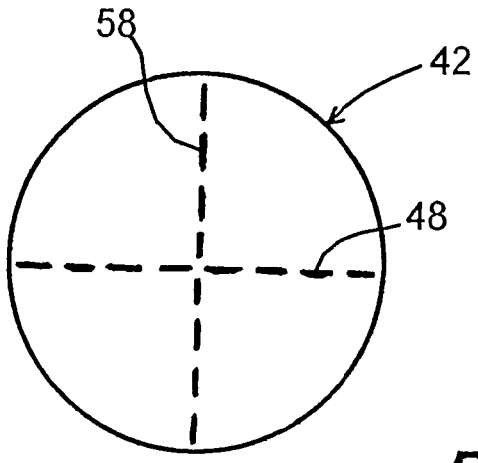
FIG. 6 is a plan view of the alternative form of feed tube shown in FIG. 5.
Figure 7:
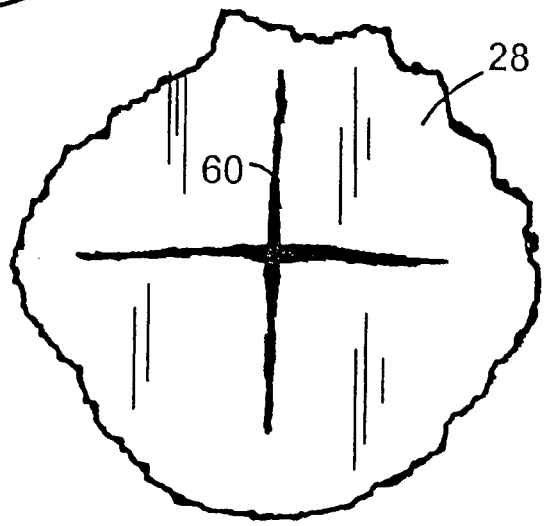
FIG. 7 shows a seal which has been ruptured by the feed tube of FIGS. 5 and 6.

Although a single row of teeth 48 is sufficient other configurations of puncturing elements could be used. For example, two intersecting rows of teeth 48 and 58 could be provided as shown in FIGS. 5 and 6, which also illustrate how the head 42 could be formed as a solid dome. Such a configuration produces a controlled cruciform rupture 60 in the sealing sheet 28, as shown in FIG. 7. Rows of small teeth are preferable to a single spike since they produce a more controlled rupturing of the seal and are also safer.

It will be appreciated that the features disclosed herein may be present in any feasible combination. Whilst the above description lays emphasis on those areas which, in combination, are believed to be new, protection is claimed for any inventive combination of the features disclosed herein.

The invention claimed is:

1. A feed tube for use in a delivery system for transferring potable liquid from an inverted container to a reservoir, the inverted container having a generally cylindrical depending neck, with a cap having an outer wall surrounding at least a portion of said neck and an internal sleeve located within the neck and joined to the outer wall by a connecting wall, the internal sleeve defining a recess for receiving the feed tube, and a frangible seal being secured to the connecting wall of the cap to cover the recess prior to insertion of the feed tube, said feed tube including a feed tube wall containing a flow path for delivering liquid from the inverted container to a reservoir, and said feed tube wall further containing one or more air passages for supplying air to the container to replace liquid removed therefrom, said feed tube carrying a head supported above said feed tube wall, said head having an uppermost end face which is provided with at least one row of upwardly-projecting puncturing elements.

2. A feed tube according to claim 1, wherein said end face of said head has a plurality of intersecting rows of puncturing elements.

3. A feed tube for use in a delivery system for transferring potable liquid from an inverted container to a reservoir, the inverted container having a generally cylindrical depending neck, with a cap having an outer wall surrounding at least a portion of said neck and an internal sleeve located within the neck and joined to the outer wall by a connecting wall, the internal sleeve defining a recess for receiving the feed tube, and a frangible seal being secured to the connecting wall of the cap to cover the recess prior to insertion of the feed tube, said feed tube containing a flow path for delivering liquid from the inverted container to a reservoir, said feed tube having at least one row of upwardly-projecting puncturing elements, each puncturing element being formed on an uppermost end face of said feed tube, and said uppermost end face being substantially dome-shaped.

4. A feed tube according to claim 1 which projects upwardly within a cup-shaped member for receiving the cap.

5. A delivery system for transferring potable liquid from an inverted container to a reservoir, including a feed tube and an inverted container, the inverted container having a generally cylindrical depending neck, with a cap having an outer wall surrounding at least a portion of the neck and an internal sleeve located within the neck and joined to the outer wall by a connecting wall, the internal sleeve defining a recess for receiving the feed tube, and a frangible seal being secured to the connecting wall of the cap to cover the recess prior to insertion of the feed tube, the feed tube containing a flow path for delivering liquid from the inverted container to a reservoir, and the feed tube having at least one row of upwardly-projecting puncturing elements.

6. A delivery system according to claim 5, in which the internal sleeve of the cap includes an integral sealing plug which is frangibly connected thereto such that insertion of the feed tube into the sleeve causes the sealing plug to be separated from the sleeve.

7. A delivery system according to claim 6, in which the sealing plug is formed with internal gripping means and the feed tube is formed with complimentary external gripping means for securing the plug on the feed tube when the feed tube is inserted into the sleeve.

8. A dispenser for potable liquid, which includes:

a reservoir;

a seat for supporting an inverted container having a generally cylindrical depending neck with a cap having an outer wall surrounding at least a portion of the neck and an internal sleeve located within the neck and joined to the outer wall by a connecting wall, the internal sleeve defining a recess for receiving a feed tube, and a frangible seal secured to the connecting wall of the cap to cover the recess prior to insertion of the feed tube; and a delivery system for transferring potable liquid from an inverted container on said seat to said reservoir, said delivery system including a cup for receiving the cap on the neck of the inverted container, said cup having a side wall, a bottom wall and a feed tube which projects upwardly from said bottom wall for insertion into the recess within the internal sleeve of the cap, said feed tube having an upwardly-projecting wall portion containing a flow path for delivering liquid from the inverted container to said reservoir, and, at the upper end of said feed tube, a head having an uppermost end face, and said feed tube has at least one row of upwardly-projecting puncturing elements formed on said uppermost end face.

9. A dispenser according to claim 8, in which said head has a groove surrounding said uppermost end face for engaging a plug which is joined to the sleeve by a frangible connection.

10. A feed tube according to claim 3, having a plurality of intersecting rows of puncturing elements.

11. A feed tube according to claim 3 which projects upwardly within a cup-shaped member for receiving the cap.

* * * * *